US006334758B1

(12) United States Patent
Popov

(10) Patent No.: US 6,334,758 B1
(45) Date of Patent: Jan. 1, 2002

(54) PUMP-EJECTOR COMPRESSION UNIT AND VARIANTS

(75) Inventor: Serguei A. Popov, 4615 Post Oak Pl., Suite 140, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/446,138

(22) PCT Filed: Apr. 16, 1999

(86) PCT No.: PCT/IB99/00678

§ 371 Date: Dec. 17, 1999

§ 102(e) Date: Dec. 17, 1999

(87) PCT Pub. No.: WO99/54630

PCT Pub. Date: Oct. 28, 1999

(30) Foreign Application Priority Data

Apr. 17, 1998 (RU) ..... 98107180

(51) Int. Cl.[7] ..... F04B 23/04

(52) U.S. Cl. ..... 417/77; 417/105; 417/173; 417/182.5; 62/116; 62/191; 62/500

(58) Field of Search ..... 417/77, 87, 105, 417/173, 182.5, 41; 62/116, 500, 191

(56) References Cited

U.S. PATENT DOCUMENTS

| | | | | | |
|---|---|---|---|---|---|
| 723,531 | A | * | 3/1903 | Jackson | 62/116 |
| 1,268,498 | A | * | 6/1918 | Scanes | 62/116 |
| 1,552,053 | A | * | 9/1925 | Davis | 417/41 |
| 1,874,912 | A | * | 8/1932 | Crosthwait, Jr. | 417/182.5 |
| 2,022,904 | A | * | 12/1935 | Thomas | 417/182.5 |
| 2,050,994 | A | * | 8/1936 | Dube | 62/191 |
| 2,088,609 | A | * | 8/1937 | Randel | 62/116 |
| 2,257,983 | A | * | 10/1941 | Shipman | 417/182.5 |
| 3,154,140 | A | * | 10/1964 | Esselman et al. | 62/500 |
| 3,490,376 | A | * | 1/1970 | Valdespino | 62/116 |
| 3,670,519 | A | * | 6/1972 | Newton | 62/116 |
| 3,717,007 | A | * | 2/1973 | Kuhlenschmidt | 62/116 |
| 5,762,687 | A | * | 6/1998 | Grossmann | 95/195 |

FOREIGN PATENT DOCUMENTS

| | | |
|---|---|---|
| DE | 1050498 | 8/1959 |
| DE | 1092044 | 11/1960 |
| RU | 2016268 | 7/1994 |
| SU | 1955 | 11/1926 |
| SU | 559098 | 7/1977 |

OTHER PUBLICATIONS

Lyamaev B.F., "Hydro–Jet pumps and units" book, 1988, USSR, Leningrad, "Mashinostroenie" Publishing house, pp. 232–233.

* cited by examiner

*Primary Examiner*—Cheryl J. Tyler
(74) *Attorney, Agent, or Firm*—Mark A. Oathout

(57) ABSTRACT

A pump-ejector compression unit is furnished with a receiver, and a mixing chamber of a liquid-gas ejector and a separator are located inside the receiver. An outlet of the mixing chamber is connected to the separator, the receiver is partly filled with a motive liquid, the liquid outlet of the receiver is connected to the suction side of a pump and the gas outlet of the receiver is connected to a consumer of a compressed gas. There is another embodiment of the compression unit, wherein the mixing chamber outlet is connected to a chamber for conversion of a gas-liquid flow. The introduced pump-ejector compression unit has an increased efficiency factor.

15 Claims, 4 Drawing Sheets

PUMP-EJECTOR COMPRESSION UNIT AND VARIANTS

This application is a 371 of International application PCT/IB99/00678 filed Apr. 16, 1999 (not published in English) which is based upon RU 98107180.

BACKGROUND ART

The invention relates to the field of jet technology, primarily to self-contained units for gas compression, mostly for compression of air.

A pump-ejector compression unit is known, which includes a pump, a separator and a jet apparatus. In this unit water is fed into the jet apparatus by the pump, falls down by gravity, thus entrains air into the apparatus and compresses it. Then the air is separated from the water in the separator. The compressed air from the separator is delivered to consumers and the water is fed back into the jet apparatus by the pump (see SU patent, 1955, MPK 6 F04 F 5/12, 30.11.1926).

The main imperfection of this compression unit is the complete dependence of the available compression ratio on the elevation of the jet apparatus over the separator. That is why in some cases dimensions of such units exceed reasonable limits and the specific material consumption during their manufacture is too high.

The closest analogue of the unit described in the present invention is a pump-ejector compression unit including a pump, a separator and a liquid-gas ejector composed of a receiving chamber, a nozzle and a mixing chamber. The liquid-gas ejector is connected through its outlet to the separator, the suction side of the pump is connected to the separator, the discharge side of the pump is connected to the ejector nozzle, the ejector receiving chamber is connected to a source of a gaseous medium, the separator gas outlet is connected to a consumer of compressed gas (see, Lyamaev B.F., "Hydro-jet pumps and units" book, Leningrad, "Mashinostroenie", 1988, pages 232–233).

This compression unit can be used as a self-contained system for delivery of a compressed gas, for example air, to a consumer. However, the efficiency factor of such units is relatively low, which is why compression units of this type have not found wide application.

SUMMARY OF THE INVENTION

The present invention is aimed at increasing the efficiency factor and compression ratio of a pump-ejector compression unit by reducing energy consumption required for gas compression.

These objectives are achieved as follows: a pump-ejector compression unit including a pump, a separator and a liquid-gas ejector composed of a receiving chamber, a nozzle and a mixing chamber, where the receiving chamber is connected to a source of a gaseous medium and the ejector nozzle is connected to the discharge side of the pump, is furnished further with a receiver, the ejector mixing chamber and the separator are located inside this receiver, an outlet of the mixing chamber is connected to the separator, the receiver is partly filled with a liquid motive medium, the liquid inlet of the receiver is connected to the discharge side of the pump, the gas outlet of the receiver is connected to a consumer of the compressed gaseous medium.

There is another embodiment of the unit providing solution(s) of the stated technical problems. In this embodiment a pump-ejector compression unit, which comprises a pump, a separator and a liquid-gas ejector composed of a receiving chamber, a nozzle and a mixing chamber, is furnished with a vortex separation element placed inside the separator and the ejector belonging to the unit is furnished with a chamber for conversion of a gas-liquid flow. In this case the suction side of the pump is connected to the separator, the discharge side of the pump is connected to the ejector nozzle, the ejector receiving chamber is connected to a source of a gaseous medium and to a source of a fresh liquid motive medium, the gas outlet of the separator is connected to a consumer of the compressed gaseous medium, the ejector mixing chamber is located inside the separator, an inlet of the conversion chamber is connected to an outlet of the mixing chamber. The chamber for conversion of a gas-liquid flow represents a divergent canal, which enlarges stepwise, and the vortex separation element is installed in the separator at the outlet of this divergent canal.

Regardless of the variant of design, the separator of the pump-ejector compression unit can be a hydrocyclone or a bent plate, in the direction of which the mixing chamber or the divergent canal is installed tangentially. The mixing chamber can have a divergent diffuser at its outlet, the receiver can be furnished with a level gage and the pump can be equipped with a regulator connected to the level gage of the receiver. The gas outlet of the separator of a hydrocyclone type located inside the receiver communicates with a gas-filled space of the receiver. The liquid outlet of the separator communicates with a liquid-filled space of the receiver. Thus a hydroseal is formed at the liquid outlet of the separator.

In addition, the unit can be furnished with a heat exchanger-cooler of the liquid motive medium installed between the liquid outlet of the receiver and the suction port of the pump, and with a heat exchanger-cooler of the compressed gaseous medium, installed at the gas discharge port of the receiver. The latter can be equipped with a pipe for removing condensate of the motive liquid and feeding it into the receiver.

Experimental research has shown that the most important factors influencing performance of the pump-ejector compression unit are the proper passing of working process in the flow-through channel of the liquid-gas ejector and consistency of operating regimes of the ejector and the separator.

It was discovered that the location of the ejector mixing chamber inside the separator allows a practically isothermal compression, which results in an increased gas compression ratio and in an increased capacity of the liquid-gas ejector at lower levels of energy consumption. Additionally, location of the mixing chamber inside the separator makes the unit more compact and ergonomic. Such an arrangement also provides a reduced specific material consumption during manufacture of the unit because in this case pressure differential on the walls of the mixing chamber is reduced and a pipe for delivery of a gas-liquid mixture from the ejector to the separator is not required. In turn, simplification of the unit design due to a reduction of structural ties between the structural components of the unit makes the unit more reliable.

If a chamber for conversion of a gas-liquid flow is installed at the outlet of the ejector mixing chamber instead of a conventional diffuser, a higher gas compression ratio can be achieved. At the same time, operation of the ejector becomes more stable and the gas-liquid flow is decelerated more effectively before its entry into the separator. This variant of the ejector design is preferable when the gas compression ratio and compactness of the unit are the foremost parameters. The variant of the ejector design without a chamber for conversion of a gas-liquid flow, i.e. the variant wherein the ejector mixing chamber has a diffuser or has nothing at all at its outlet, is more simple in production and more advisable in case of a relatively low required capacity of the compression unit.

There is a distinction in kind between operation of a chamber for conversion of a gas-liquid flow and a diffuser. A diffuser is designed for smooth transformation of kinetic energy of a flow into pressure with minimal energy losses, while the chamber for conversion of a gas-liquid flow is able to provide a much higher compression ratio because a gas-liquid flow undergoes more vigorous transformations in this chamber and consequently other processes take place there. In the conversion chamber the flow is subjected to abrupt expansion in a divergent canal which enlarges stepwise. As a result of the expansion density of the flow drops, mainly due to expansion of its gaseous components. Therefore speed of sound in this gas-liquid medium is significantly reduced. That allows conversion of the flow into a supersonic or at least a sonic flow regime. Then a pressure jump is organized in the supersonic flow, while the flow passes through the expanded section of the canal. The expanded section of the canal can be cylindrical or divergent. The flow is abruptly decelerated in the pressure jump and thus the gaseous components of the gas-liquid medium are abruptly compressed.

Other important aspects which affect operation of the compression unit as a whole are arrangement of proper feeding of the gas-liquid mixture into the separator and then into the receiver as well as arrangement of an optimal regime of separation of the mixture into the motive liquid and compressed gas. For the most effective performance of the receiver it is necessary to reduce velocity of the motive liquid flow to the minimal possible level. At the same time kinetic energy of the gas-liquid flow can be used to intensify separation of the liquid and gaseous mediums. Toward this end the gas-liquid flow is strongly swirled at the inlet of the separator, for example in a hydrocyclone or on a shaped, bent plate. On the one hand, this motion of the flow along a curved surface ensures almost complete separation of the compressed gas from the motive liquid. On the other hand, such a shape of the curved surface can be chosen which provides a quite low speed of the motive liquid flow at the point where the flow enters the receiver. The receiver operates as a storage tank, where the compressed gas is stocked, and at the same time, as a precipitation tank, where the process of separation of the liquid and gaseous mediums is finalized. Because the gas outlet of the separator (hydrocyclone for example) communicates with the gas-filled space of the receiver and the liquid outlet of the separator communicates with the liquid-filled space of the receiver, it is possible to reduce the quantity of cross-over pipes. The design of the separator provides the option to arrange a hydroseal between the liquid outlet of the separator and the receiver if necessary. In a number of cases this can improve operational reliability of the compression unit. So, the given layout of the receiver, mixing chamber and separator makes the structure of the compression unit very compact, with a minimal number of cross-over pipes. Consequently, the unit operates with minimal hydraulic losses.

Regardless of the variant of the embodiments, separators of various types can be applied in the described pump-ejector compression unit. A preferable type of the separator and the variant of the unit configuration are determined in many respects by the required capacity of the compression unit. For example, when the unit capacity is relatively high, the separator of a hydrocyclone type can be used. A hydrocyclone separator represents a cylindrical shaped body with tangential feeding of a liquid-gas mixture. If the hydrocyclone separator is applied in the compression unit, a compressed gas is discharged from the separator into the gas-filled section of the receiver through a central manifold and a motive liquid is discharged through a shaped (conical for example) manifold into the liquid-filled section of the receiver. When the required capacity of the unit is relatively low a separator of more simple design can be used. In this case the separator can represent for example just a bent plate. The ejector mixing chamber or the divergent canal of the chamber for conversion of a gas-liquid flow must be connected tangentially to this shaped, bent plate.

Insignificant carry-over of the motive liquid vapors into the compressed gas is unavoidable during operation of the compression unit. In order to make up the motive liquid, a pipe for delivery of fresh motive liquid must be connected to the receiving chamber of the liquid-gas ejector. Such an arrangement allows injection of the fresh motive liquid from a reservoir with the use of energy of the motive liquid jet flowing from the ejector nozzle without shutdown of the unit. And what is more, this scheme of the liquid make-up supply makes possible the complete replacement of the motive liquid during operation of the compression unit if necessary. Such a necessity can arise for example in the case of compression of a dusty gas, when agglomeration of a sediment may occur in the receiver. It is necessary to note that in the case in question, the described compression unit provides purification of the gas from the dust simultaneously with the gas compression. It is preferable to disperse the fresh motive liquid in the receiving chamber. Atomization of the liquid can be realized by means of a centrifugal nozzle or another conventional device for spraying liquids installed on the end of the pipe for delivery of the fresh motive liquid.

The motive liquid is heated gradually while performing compression of a gaseous medium. Great heating of the motive liquid can result in a decrease of the unit capacity. To avoid such consequences it is advisable to equip the unit with a heat exchanger-cooler installed for example in the line for the motive liquid delivery from the receiver to the suction port of the pump. In addition, another heat exchanger-cooler can be installed in the compressed gas discharge line in order to reduce carry-over of the motive liquid from the compression unit and to cool the compressed gas (if necessary). The latter cooler can be furnished with a pipe for export of a condensate of the motive liquid vapors back to the receiver.

Thus, the introduced compression unit provides a solution to the stated technical problems: the unit has a higher efficiency factor, a higher capacity and a higher gas compression ratio.

DETAILED DESCRIPTION OF THE INVENTION

Figure 1:
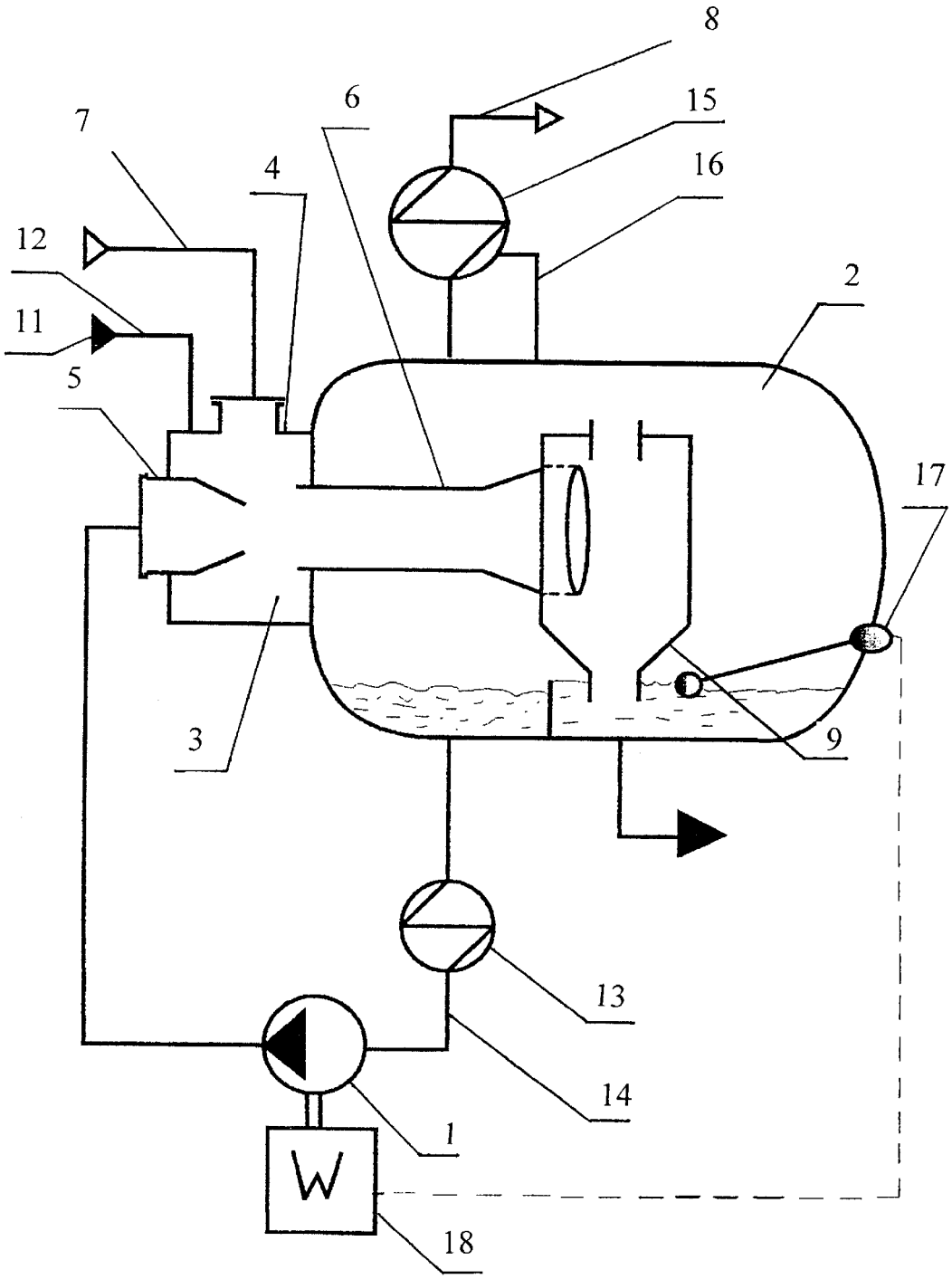
FIG. 1 represents a schematic diagram of the described pump-ejector compression unit.
Figure 2:
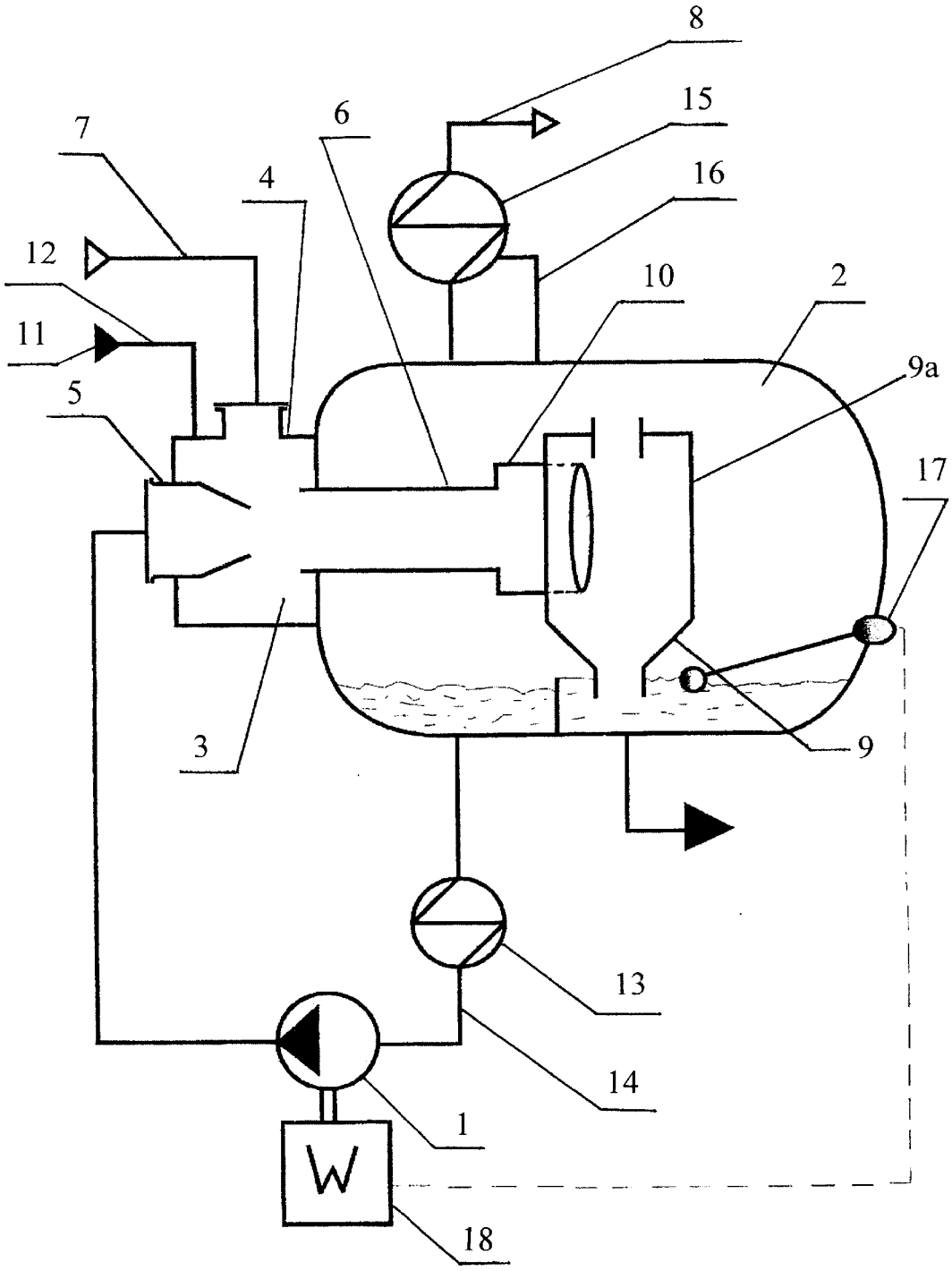
FIG. 2 represents a schematic diagram of the unit, wherein a liquid-gas ejector has a chamber for conversion of a gas-liquid flow.
Figure 3:
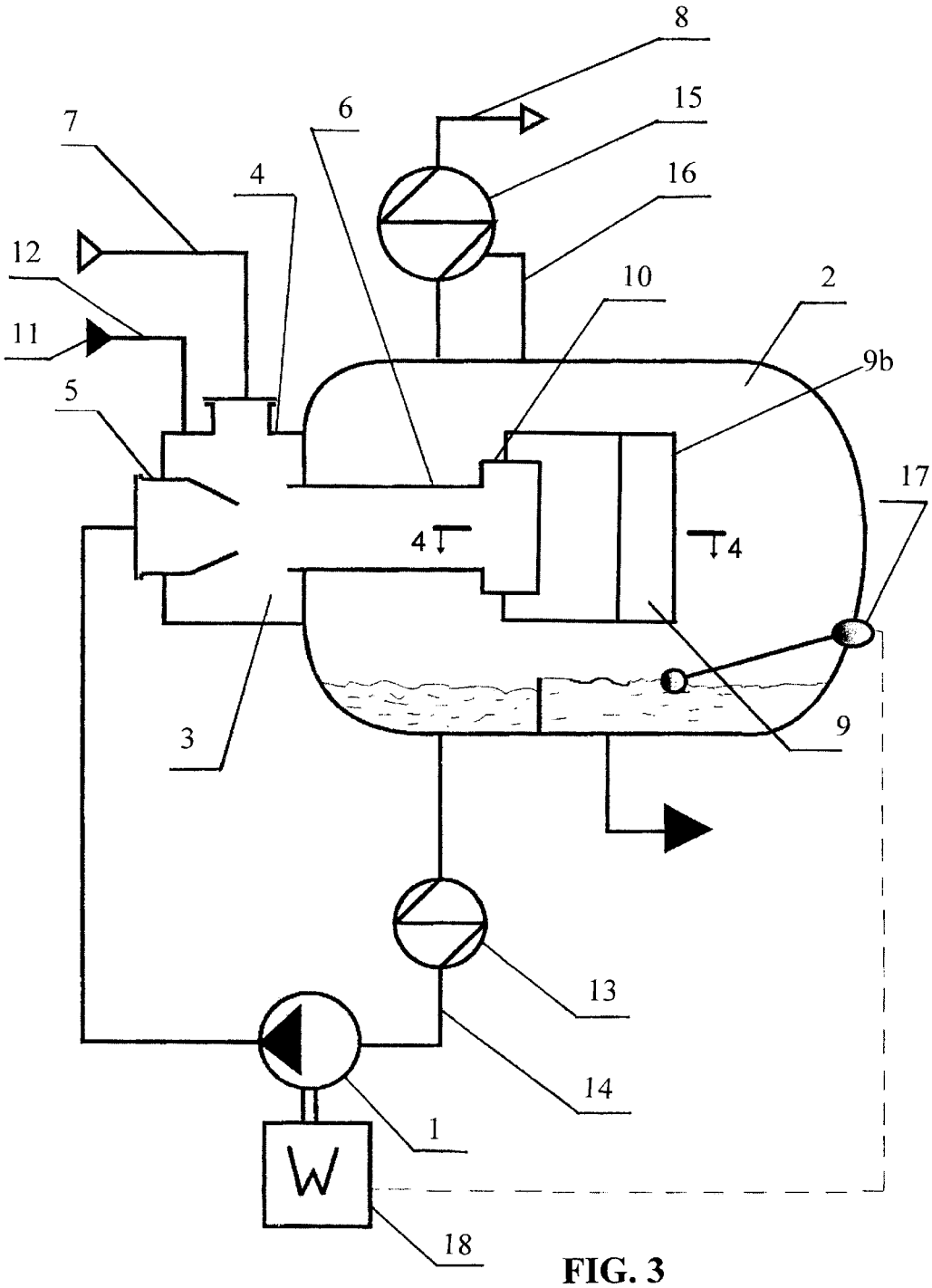
FIG. 3 represents a schematic diagram of the compression unit whose separator represents a bent plate.
Figure 4:
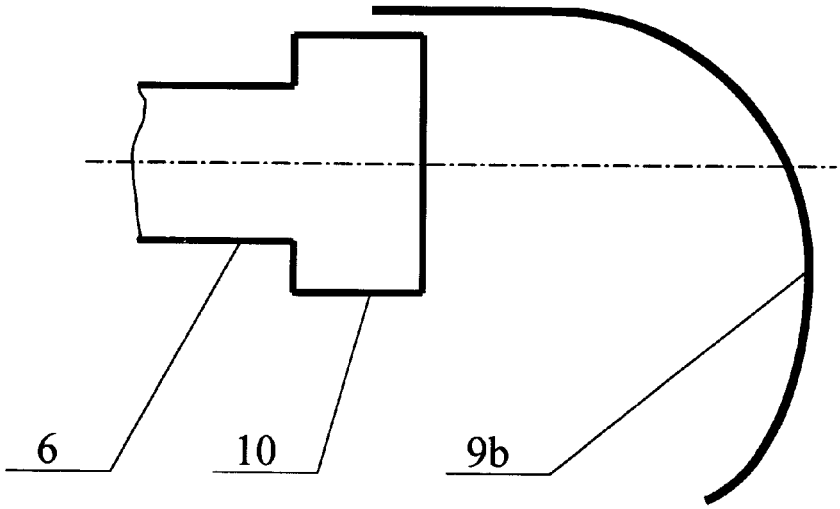
FIG. 4 represents a schematic sectional view taken along line 4—4 of FIG. 3 explicating the position of the bent plate relative to the mixing and flow conversion chambers of a liquid-gas ejector.

The pump-ejector compression units (FIG. 1, FIG. 2 and FIG. 3) include a pump 1, a receiver 2, a liquid-gas ejector 3 composed of a receiving chamber 4, a nozzle 5 and a mixing chamber 6. An outlet of the liquid-gas ejector 3 is connected to a separator 9, the suction side of the pump 1 is connected to the receiver 2, the discharge side of the pump 1 is connected to the nozzle 5 of the ejector 3, the receiving chamber 4 of the ejector 3 is connected to a source 7 of a gaseous medium to be compressed, a pipe 8 for discharge of compressed gas from the receiver 2 is connected to a consumer of compressed gas. The ejector 3 can be furnished with a chamber 10 (FIGS. 2–4) for conversion of a gas-liquid flow. In this case the mixing chamber 6 of the ejector 3 is located inside the receiver 2, the receiving chamber 4 of the ejector 3 is connected to a source 11 of fresh motive liquid through a pipe 12 for feeding fresh motive liquid, the chamber 10 is connected to an outlet of the mixing chamber 6 and the chamber 10 defines a divergent canal enlarging stepwise, the separator 9 is installed inside the receiver 2 at the end of the divergent canal of the chamber 10.

The separator 9 can represent a hydrocyclone 9*a* or a bent plate 9*b*. The divergent canal of the chamber 10 should be connected to the bent plate 9*b* tangentially (see FIG. 3 and FIG. 4).

The unit can be equipped with a heat exchanger-cooler 13 installed on the line 14 for delivery of a motive liquid from the receiver 2 to the suction port of the pump 1, and with a heat exchanger-cooler 15 for cooling compressed gas installed in the gas discharge line 8 of the receiver 2. The heat exchanger-cooler 15 can be furnished with a pipe 16 for export of the motive liquid condensate to the receiver 2. The receiver 2 can be equipped with a level gage 17, the pump 1 can be equipped with a regulator 18 connected to the gage 17 of the receiver 2.

The pump-ejector compression units operate as follows.

Prior to starting of the unit the receiver 2 is filled with a motive liquid up to the specified level. The pump 1 delivers the motive liquid under pressure from the receiver 2 into the nozzle 5 of the liquid-gas ejector 3. A jet of the motive liquid flowing out of the nozzle 5 entrains a gaseous medium to be compressed from the receiving chamber 4 into the mixing chamber 6. The gaseous medium enters the chamber 4 through the pipe 7 (however the chamber 4 can communicate directly with the environment and in this case air will be the compressed gas). A gas-liquid mixture is formed in the mixing chamber 6. At the same time the gaseous medium undergoes compression under impact of the motive liquid energy. Subject to the variant of the embodiment the gas-liquid mixture moves from the mixing chamber 6 directly into the separator 9 or into the divergent canal of the chamber 10 for conversion of the gas-liquid flow, where the gas-liquid flow first is converted into a supersonic flow by an abrupt expansion. Then the supersonic flow is abruptly decelerated in a pressure jump which results in a discontinuous rise in pressure of the gaseous components. Then the flow from the chamber 10 or from the mixing chamber 6 passes into the separator 9, where compressed gas is separated from the more dense motive liquid due to swirling of the gas-liquid flow on a curved surface of the hydrocyclone 9*a* or on the shaped, bent plate 9*b*. The motive liquid and compressed gas flow from the separator 9 into the receiver 2, where separation of the motive liquid and compressed gas is completed. The compressed gas is delivered to a consumer through the pipe 8, the motive liquid is fed from the receiver 2 to the suction side of the pump 1 through the pipe 14. The pump 1 delivers the motive liquid again into the nozzle 5 of the ejector 3.

If it is necessary, the motive liquid is cooled in the heat exchanger-cooler 13 prior to its feeding from the receiver 2 to the pump 1 and the compressed gas is cooled in the heat exchanger-cooler 15 prior to its delivery to the consumer. Condensate of the motive liquid vapors can be collected in the heat exchanger-cooler 15. This condensate is delivered from the heat exchanger-cooler 15 through the pipe 16 into the receiver 2, where the condensate mixes with the motive liquid which moves into the ejector 3.

The receiver 2 is equipped with the level gage 17, and the pump is equipped with the regulator 18 connected to the gage 17. These instruments provide for automatic adjustment of the operational mode of the pump 1 in accordance with the motive liquid level in the receiver 2. As a result, operation of the compression unit becomes more reliable because, in this case, such an operational mode of the unit, when the liquid level in the receiver 2 falls below an allowed limit and operation of the liquid-gas ejector (and consequently of the whole compression unit) becomes unstable, is prevented.

INDUSTRIAL APPLICABILITY

The given pump-ejector compression unit can be applied in agriculture, civil construction and in other industries, where gas compression is required.

What is claimed is:

1. A pump-ejector compression unit, comprising:

a pump;

a separator;

a receiver; and a liquid-gas ejector having a receiving chamber, a nozzle and a mixing chamber;

wherein the mixing chamber and the separator are located inside said receiver;

wherein the receiving chamber of the liquid-gas ejector is connected to a source of a gaseous medium and the nozzle is connected to a discharge side of the pump;

wherein an outlet of the mixing chamber is connected to the separator; and wherein said receiver is partly filled with a motive liquid, a liquid outlet of said receiver is connected to a suction side of the pump and a gas outlet of said receiver is connected to a consumer of a compressed gaseous medium.

2. The pump-ejector compression unit according to claim 1, wherein the receiving chamber of the liquid-gas ejector is connected to a source of a fresh motive liquid.

3. The pump-ejector compression unit according to claim 1, wherein the separator comprises a hydrocyclone, having a hydrocyclone compressed gas outlet which communicates with a gas-filled space defined by said receiver, and a hydrocyclone liquid outlet which communicates with a liquid-filled space defined by said receiver whereby a hydroseal is formed at the hydrocyclone liquid outlet.

4. The pump-ejector compression unit according to claim 1, wherein the separator comprises a bent plate and the mixing chamber is installed tangent to said bent plate.

5. The pump-ejector compression unit according to claim 4, wherein said bent plate is bent in a horizontal plane.

6. The pump-ejector compression unit according to claim 1, wherein an outlet section of the mixing chamber defines a divergent canal.

7. The pump-ejector compression unit according to claim 1, further comprising a heat exchanger-cooler installed in a line for the motive liquid wherein the line for the motive liquid is connected to said receiver and to the suction side of the pump.

8. The pump-ejector compression unit according to claim 1, further comprising a heat exchanger-cooler installed in a line for discharge of the compressed gaseous medium connected to said receiver, and a pipe for export of a condensate of a motive liquid vapor to said receiver.

9. The pump-ejector compression unit according to claim 1, wherein said receiver includes a level gage and the pump includes a regulator connected to the level gage of said receiver.

10. The pump-ejector compression unit according to claim 1, wherein the outlet of the mixing chamber is directly connected to the separator.

11. A pump-ejector compression unit comprising a pump;

a separator;

a receiver; and a liquid-gas ejector having a receiving chamber, a nozzle, a mixing chamber and a chamber for conversion of a gas-liquid flow;

wherein the receiving chamber of the liquid-gas ejector is connected to a source of a gaseous medium and the ejector nozzle is connected to a discharge side of the pump;

wherein the mixing chamber, said chamber for conversion of a gas-liquid flow and the separator are located inside said receiver;

wherein said chamber for conversion of a gas-liquid flow defines a divergent canal enlarging stepwise, an inlet of said chamber for conversion of a gas-liquid flow is connected to a mixing chamber outlet, an outlet of said chamber for conversion of a gas-liquid flow is connected to the separator;

wherein said receiver is partly filled with a motive liquid, a liquid outlet of said receiver is connected to a suction side of the pump and a gas outlet of said receiver is connected to a consumer of a compressed gaseous medium.

12. The pump-ejector compression unit according to claim 11, wherein the separator comprises a bent plate and the divergent canal of said chamber for conversion of a gas-liquid flow is installed tangent to said bent plate.

13. The pump-ejector compression unit according to claim 11, further comprising a heat exchanger-cooler, installed in a line for the motive liquid wherein the line for the motive liquid is connected to said receiver and to the suction side of the pump.

14. The pump-ejector compression unit according to claim 11, further comprising a heat exchanger-cooler for cooling the compressed gaseous medium, installed in a line for discharge of the compressed gaseous medium connected to said receiver, and a pipe for export of a condensate of a motive liquid vapor connected to said receiver.

15. The pump-ejector compression according to claim 11, wherein said receiver includes a level gage and the pump includes a regulator connected to the level gage of said receiver.

* * * * *